United States Patent [19]

Johnstone

[11] Patent Number: 4,476,658

[45] Date of Patent: Oct. 16, 1984

[54] STANDING SEAM ROOF SYSTEM

[75] Inventor: Thomas O. Johnstone, Lancaster, Pa.

[73] Assignee: Alcan Aluminum Corporation, Cleveland, Ohio

[21] Appl. No.: 246,328

[22] Filed: Mar. 23, 1981

[51] Int. Cl.[3] ..... E04C 1/34; E04D 1/34; E04D 1/38

[52] U.S. Cl. ..... 52/395; 52/404; 52/466

[58] Field of Search ..... 52/466, 465, 468, 404, 52/519, 520, 542, 530, 395, 469, 465

[56] References Cited

U.S. PATENT DOCUMENTS

| | | | |
|---|---|---|---|
| 1,762,756 | 6/1930 | Braunstein | 52/466 X |
| 2,095,434 | 10/1937 | Calkins et al. | 52/469 |
| 2,680,503 | 6/1954 | Clarke | 52/469 |
| 2,790,691 | 4/1957 | Goebel | 52/469 X |
| 3,486,281 | 12/1969 | Gregoire | 52/469 X |
| 4,117,638 | 10/1978 | Kidd, Jr. | 52/466 |
| 4,139,974 | 2/1979 | Fox | 52/468 |
| 4,366,656 | 1/1983 | Simpson | 52/395 |

FOREIGN PATENT DOCUMENTS

| | | | |
|---|---|---|---|
| 1934524 | 2/1973 | Fed. Rep. of Germany | 52/466 |
| 2913060 | 10/1980 | Fed. Rep. of Germany | 52/463 |
| 963461 | 7/1950 | France | 52/465 |

*Primary Examiner*—Alfred C. Perham
*Attorney, Agent, or Firm*—Cooper, Dunham, Clark, Griffin & Moran

[57] ABSTRACT

A roofing panel system including a plurality of elongated panels disposed in side-by-side parallel array on a supporting roof structure, each panel having an upwardly projecting longitudinal flange along each side with the flanges of adjacent panels together constituting a standing seam at the junction of the panels. A plurality of clips, fastened to the roof structure along each standing seam and interposed between the adjacent panel flanges constituting that seam, engage the tops of the adjacent panel flanges to anchor the panels to the roof structure and also support the adjacent panels from below. Each standing seam is covered by an elongated cap member snap-fitted over the tops of the adjacent panel flanges and bearing sealant material which engages the tops of the latter flanges to seal the seam. The top portion of each panel flange is bent toward the other flange of the panel to form a leg, over which the cap member extends, having a flat upwardly facing surface for contact with the sealant material. The clips can be formed to support the panels in outwardly spaced relation to the roof structure to provide a gap for receiving thermally insulating material.

6 Claims, 7 Drawing Figures

Fig. 1.
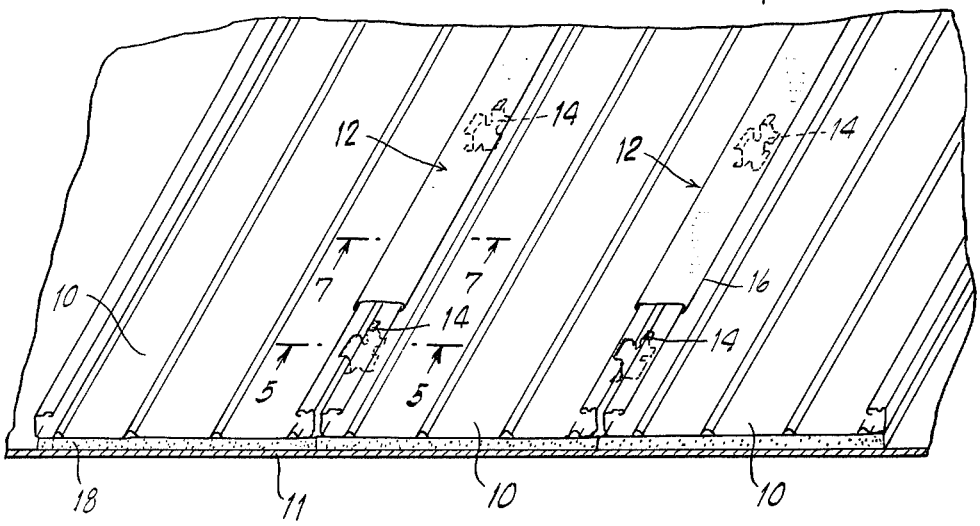
Fig. 2.
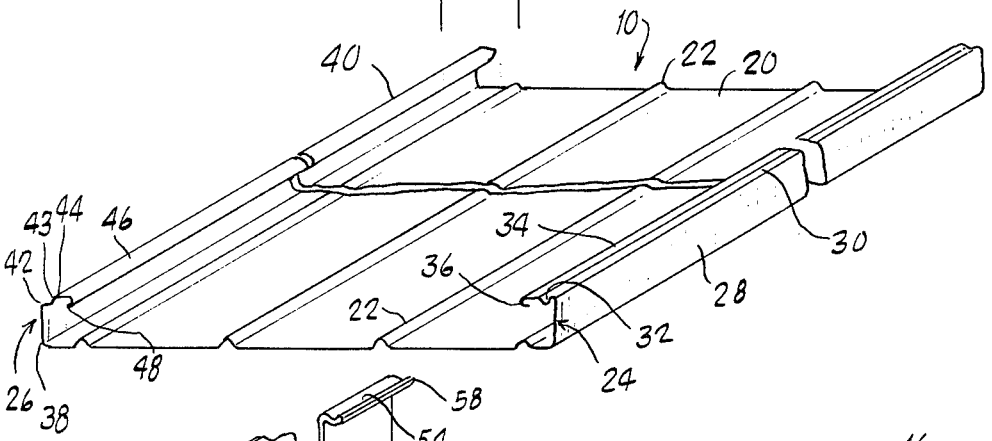
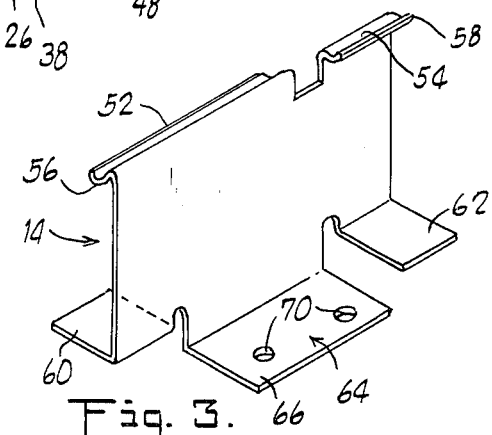
Fig. 3.
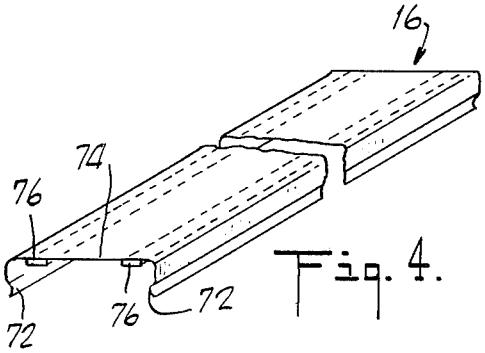
Fig. 4.

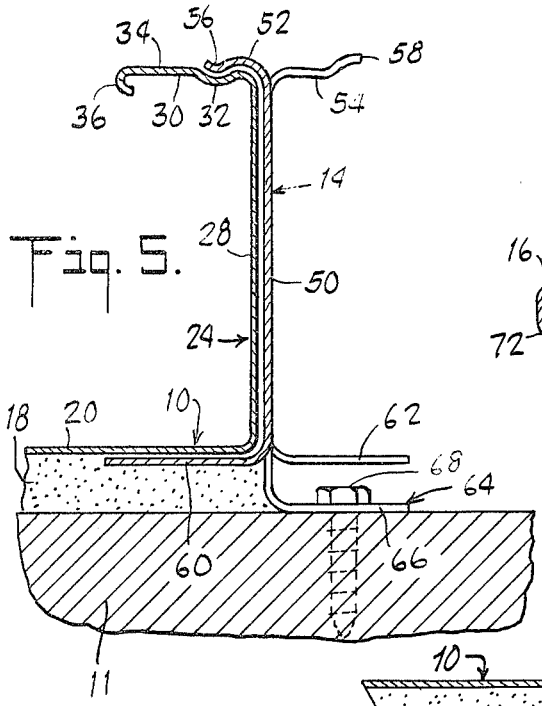
Fig. 5.
Fig. 6.
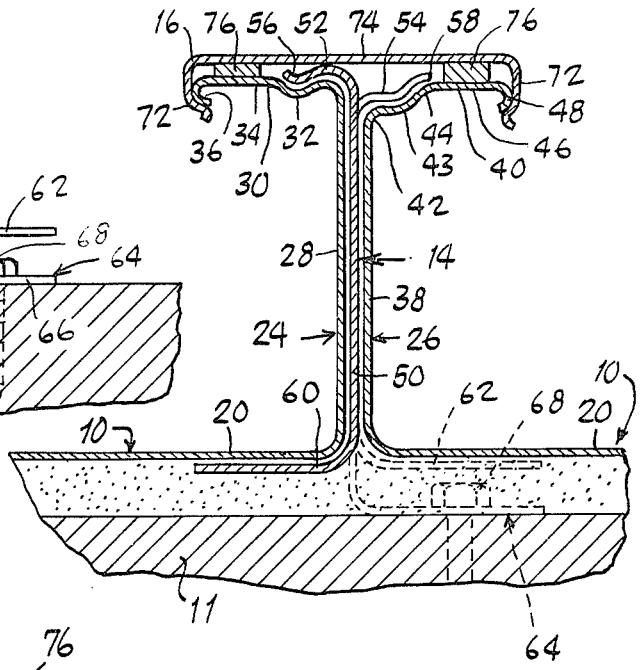
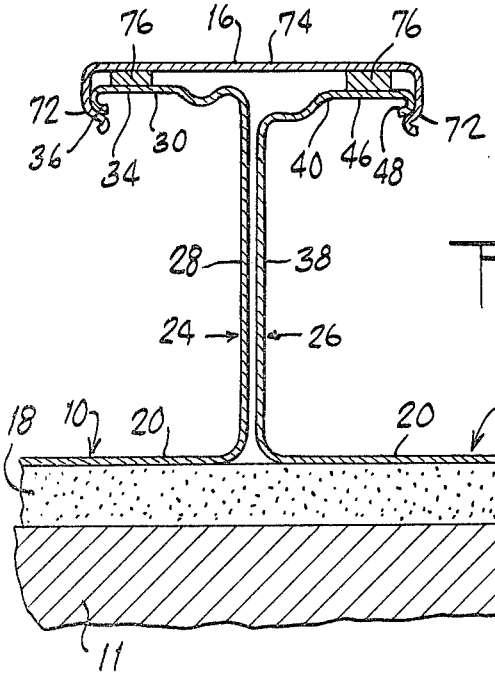
Fig. 7.

STANDING SEAM ROOF SYSTEM

BACKGROUND OF THE INVENTION

This invention relates to roof systems, and more particularly to sheet panel roof systems of the standing seam type.

Panels of substantially rigid sheet material, such as roll-formed sheet metal (e.g. aluminum or steel) panels, are widely used for roofing, either to provide a protective outer cladding for a continuous roof substructure of wood or the like, or in themselves to constitute a roof when mounted directly on a support structure of spaced beams. In many instances, it is preferred to employ a so-called standing seam roof system, comprising a plurality of elongated, channel-shaped sheet panels each having a central web and first and second longitudinal flanges respectively projecting upwardly (e.g. as much as two or more inches) from the web along opposite sides of the panel, the flanges being commonly formed with one or more inward and/or outward bends. These panels are disposed on a supporting roof structure in side-by-side parallel array, the roof structure typically having at least a slight pitch and the panels being oriented with their long dimensions perpendicular to the ridge of the roof; the first longitudinal flange of each panel lies closely adjacent the second longitudinal flange of the next panel to constitute therewith a standing seam, so that there is a standing seam at each junction between adjacent parallel panels in the array. A plurality of clips, fixedly secured to the supporting roof structure at spaced locations along each standing seam are interposed between (and engage) the adjacent panel flanges constituting that seam to anchor the panels to the roof structure. For protection against penetration by moisture, each standing seam may be covered by an elongated cap member mounted thereon, or the flanges constituting the seam may be nestingly interfitted with each other; in addition, caulking or sealant material may be provided along the seam.

It is to be understood that the terms "inwardly" and "outwardly" (or "inward" and "outward") as used herein refer, respectively, to directions toward and away from the plane longitudinally bisecting and perpendicular to the central web of a panel, while terms such as "upper," "upward," "above," "lower," "downward," and "below" refer to vertical directions obtaining when the panel is mounted in its intended or customary orientation on a roof.

A standing seam roof system as described above affords significant advantages in comparison to other types of sheet panel roof systems. In particular, the panels of a standing seam system are not penetrated by screws or other fasteners except at the eave and ridge of the roof (and at overlapping ends of panels in cases where the eave-to-roof distance is greater than the length of one panel), and the panels are free to expand and contract (with change of temperature) to a significantly greater extent than if they were fixedly fastened by nails or screws along their lengths. The problem of undesired entry of water to a building through fastener holes in roof panels is thereby greatly reduced, as is the related problem of fastener hole enlargement (and consequently increased admission of water) incident to panel expansion and contraction. The channel-shaped panels also act as wide, deep rain-carrying troughs, enabling use of the panels on roofs of very slight pitch without resort to costly expedients for preventing leaks.

Various difficulties, however, have been presented by standing seam roof systems heretofore known or proposed. In many of such systems, closure of the standing seams requires deformation of the cap member or interfitted panel flanges with a special, powered crimping or seaming machine at the installation site; the provision and operation of this machine is undesirably costly, inconvenient, and time-consuming for the installer. Other standing seam systems present disadvantageous complexity in fabrication or installation, because of the number or intricacy of their components and/or because of the high precision required for proper assembly. In some systems, the seams are sealed at locations likely to be immersed (and thus vulnerable to leakage) in heavy rains; or the seams have an aesthetically undesirable asymmetrical appearance. Moreover, known types of anchoring clips, though holding the panels on the roof structure, commonly do not support the panels, and therefore the panels can be installed with such clips only on types of roof structures that themselves provide direct support for the panels.

SUMMARY OF THE INVENTION

The present invention broadly contemplates the provision of a standing seam roof system of the general type described above, viz. including panels with first and second longitudinal flanges, anchoring clips fixedly secured at spaced locations along each standing seam, and an elongated cap member covering each standing seam, incorporating a combination of structural features which overcome the aforementioned problems that have heretofore characterized such systems.

In accordance with the invention, the upper portion of each longitudinal flange of each panel is bent inwardly to form a longitudinal leg extending toward the other flange of the panel in vertically spaced parallel relation to the web, and each such leg has an upwardly facing flat portion parallel to the panel web. Also, each of the anchoring clips includes a flat vertical body interposed between the first flange of one panel and the second flange of the next panel at a standing seam, first and second upper portions respectively projecting in opposite directions from the top of the flat body for respectively overlying and engaging the legs of the last-mentioned first and second flanges, and first and second lower portions respectively projecting in opposite directions from the flat body below the upper portions for respectively underlying and supporting the webs of the aforesaid one panel and next panel at the last-mentioned seam. Further, each cap member is an elongated, resiliently deformable member of downwardly opening C-shaped cross section snap fitted over the leg of the first flange of one panel and the leg of the second flange of the next panel at a standing seam to cover the gap therebetween, above the upper portions of the anchoring clips at that standing seam; and a body of sealant material is interposed between each of the cap members and the upwardly facing flat portion of each flange leg over which the cap member is fitted, along the full length of the cap member.

In currently preferred embodiments of the invention, each leg of each panel flange has a free longitudinal edge formed with a return curve, and each cap member has two resilient inwardly curved longitudinal legs spaced apart, in unstressed condition by a distance such that when the cap member is pressed downwardly over the legs of adjacent flanges at a standing seam, the cap member legs deform outwardly to slide downwardly over the return curves of the last-mentioned flange legs and then spring back toward each other to grippingly engage the last-mentioned flange legs. Further, the upwardly facing flat portion of each panel flange leg projects inwardly of the clip upper portion engaging that leg so as to be continuously exposed along the length of the panel, and each cap member has a central web with a downwardly facing surface bearing two longitudinal strips of the sealant material respectively positioned to come into contact with the continuously exposed flat portions of the two flange legs over which the cap member is snap fitted. Each clip may include a foot portion extending downwardly from the flat body of the clip and fixedly securable to the roof structure, for supporting the clip thereon with the lower portions of the clip spaced above the roof structure to provide a gap (e.g. for insulating material) between the roof structure and the panel webs.

The invention thus provides an advantageously simple three-component standing seam roof system which is very easily installed, in particular requiring no powered crimping or seaming machine, because the cap members can be manually snap fitted into continuous engagement with the panel flanges along the full length of the standing seams. The seams are sealed at the location (their highest point, i.e. the upwardly facing flat surface portions of the panel flange legs) which is least vulnerable to immersion and leakage, and they are attractively symmetrical in appearance. At the same time, the support provided for the panels by the anchoring clips enables installation of the system on roof structures (such as spaced beams) that do not directly support the panels, and facilitates the provision of a layer of thermal insulation beneath the panels.

Further features and advantages of the invention will be apparent from the detailed description hereinbelow set forth, together with the accompanying drawings.

BRIEF DESCRIPTION OF THE DRAWINGS

FIG. 1 is a fragmentary view of an assembled roof system embodying the present invention in a particular form;

FIG. 2 is an enlarged fragmentary perspective view of one of the roofing panels of the system of FIG. 1;

FIG. 3 is a further enlarged perspective view of one of the anchoring clips of the system of FIG. 1;

FIG. 4 is a still further enlarged fragmentary perspective view of one of the cap trim members of the system of FIG. 1;

FIGS. 5 an 6 are enlarged cross-sectional views taken as along the line 5—5 of FIG. 1 illustrating success stages in the installation of the system of FIG. 1; and FIG. 7 is an enlarged cross-sectional view taken along the line 7—7 of FIG. 1.

DETAILED DESCRIPTION

Referring to the drawings, the invention will be described as embodied in a roof system (FIG. 1) comprising an array of elongated sheet metal roofing panels 10 disposed in side-by-side parallel array on a pitched supporting roof structure 11 (illustrated, for simplicity, as a continuous roof substructure e.g. of wooden boards), with the long dimensions of the panels oriented perpendicularly to the ridge (not shown) of the roof. The panels have upstanding longitudinal side flanges, hereinafter described, which cooperatively constitute standing seams 12. The described system further includes a plurality of anchoring clips 14 fixedly secured to the roof structure 11 at spaced locations along each standing seam, for engaging the panel flanges to anchor the panels to the roof structure, and, for each standing seam, a cap member 16 mounted thereon and extending over the full length of the seam to cover the seam outwardly. A layer 18 of thermal insulation is shown as interposed between the panels and the subjacent roof structure. Again for simplicity of illustration, neither the manner of securing the panel ends to the roof structure, nor the eave and ridge trim, are shown, since these features may be generally conventional and are not part of the present invention.

In this system, each of the panels 10 is a wide, deep roll-formed sheet aluminum or steel panel, of conventional gauge for aluminum or steel roofing panels, and is conveniently produced by generally conventional forming operations. Typically, each panel may be 12, 18 or 24 inches wide, and many feet long. If desired, it may be protectively or decoratively coated, at least on its exposed surfaces.

More particularly, each panel 10 (FIG. 2) has a generally planar central web 20 (in which one or more shallow longitudinal ribs 22 may be formed) and first and second longitudinal flanges 24 and 26 respectively projecting upwardly therefrom along opposite sides of the panel. By way of example, the outside vertical dimension of the first flange 24 may be 2 7/16 inches, and the corresponding dimension of the second flange 26 may be $2\frac{3}{8}$ inches. The panel web 20 and the flanges 24 and 26 cooperatively define an upwardly opening channel which can serve as a rain-carrying trough in the assembled roof system.

The first flange 24 includes a lower, vertical portion 28 and an upper portion bent inwardly to form a longitudinal leg 30 extending toward the second flange 26 in vertically spaced parallel relation to the web 20. This leg 30 is formed with a longitudinal, upwardly concave groove 32 and an upwardly facing flat portion 34 (parallel to the web 20) disposed inwardly of the groove 32; it has a free longitudinal inner edge formed with a return curve 36. Similarly, the second flange 26 includes a lower, vertical portion 38 and an upper portion bent inwardly to form a longitudinal leg 40 extending toward the first flange 24 in vertically spaced parallel relation to the panel web. The leg 40 curves initially inwardly at 42, then upwardly at 43, and then again inwardly at 44; it also has an upwardly-facing flat portion 46 (parallel to the web 20), disposed inwardly of the latter curve, and a free longitudinal inner edge formed with a return curve 48. It will be understood that, although the panel 10 is sufficiently rigid to be self-sustaining in shape, nevertheless (being of conventional sheet aluminum or steel roofing gauge) it is somewhat resiliently deformable, and thus the flanges 24 and 26 are capable of some degree of springlike movement as is desirable to facilitate installation.

Each of the anchoring clips 14 (FIG. 3) is an integral element produced by cutting and bending an initially flat, unitary piece of sheet metal of thick enough gauge to possess the strength and rigidity needed to support the panels. The flat central body 50 of the clip 14 lies substantially in a vertical plane, and in the assembled roof system (FIG. 6) is interposed between and parallel to the vertical portion 28 of the first flange 24 of one panel and the adjacent vertical portion 38 of the second flange 26 of the next panel at a standing seam 12 constituted by the last-mentioned first and second flanges. A first upper flange portion 52 and a second upper flange portion 54, staggered along the length of the clip, respectively project in opposite directions (generally perpendicular to the plane of the flat body 50) from the top of the flat body for respectively overlying and engaging the leg 30 of the first flange 24 of one panel and the leg 40 of the second flange 26 of the adjacent panel at a standing seam. As best seen in FIGS. 5 and 6, the first upper portion 52 of the clip is formed with a downwardly convex bead 56 receivable in the groove 32 of the first-flange leg 30 of a panel, while the second upper portion 54 of the clip curves upwardly to a free longitudinal edge 58 for conformingly overlying the curved portion 42–44 of the second-flange leg 40 of a panel. Each of the clip upper portions 52 and 54 is substantially narrower than the panel flange leg it overlies; thus, in the assembled system, the upwardly facing flat portions 34 and 46 of the panel flange legs 30 and 40 project inwardly of the clip upper portions 52 and 54 respectively engaging them so that these upwardly facing flat portions of the flange legs are continuously exposed along their length.

Each of the clips 14 also includes first and second flat lower flange portions 60 and 62 respectively projecting from the clip body 50 in opposite directions (normal to the plane of the clip body) below the upper portions 52 and 54 for respectively underlying and supporting the webs of the two panels having flanges engaged by the clip upper portions. The two lower flange portions 60 and 62 are coplanar, and each of them is substantially wider (measured in a direction normal to the plane of the clip body) than the clip upper portion it underlies, to ensure that the panels are adequately supported. The vertical spacing between the clip lower portion 60 and upper portion 52 corresponds to the outside vertical dimension of the first panel flange 24 so that when the clip upper portion 52 engages the leg 30 of that flange, the clip lower portion 60 underlies and supports the panel web 20 adjacent that flange; similarly, the vertical spacing between the clip lower portion 62 and upper portion 54 corresponds to the outside vertical dimension of the second panel flange 26.

In the illustrated embodiment of the invention, each clip 14 also has an L-shaped mounting foot 64 extending downwardly from the body 50 below the plane of the lower portions 60 and 62 and terminating in a lateral flange 66 extending parallel to the latter plane. The flange 66 rests on the supporting roof structure 11 and is fastened thereto (to secure the clip to the roof structure) with one or more screws 68 extending through holes 70 in the flange. The vertical spacing between the clip lower portions 60 and 62 and the flange 66 provides a gap (between the panels and the roof structure) for the layer 18 of insulation.

Each of the cap members 16 (FIG. 4) is a relatively light-gauge roll formed sheet aluminum or steel channel, of downwardly opening C-shaped cross section, with two resiliently deformable inwardly curved longitudinal legs 72 and a central web 74. The spacing between the lower edges of the two legs 72 in unstressed condition is less than the combined width of the legs 30 and 40 of the two adjacent panel flanges constituting a standing seam. When the cap member is pressed downwardly over the legs of adjacent flanges at a standing seam, the cap member legs 72 deform outwardly so that their lower edges slide downwardly over the return curves 36 and 48 of the panel flange legs, and snap or spring back toward each other to grippingly engage the latter panel flange legs continuously along the length of the standing seam, securely holding the cap member on the seam.

The downwardly facing surface of the central web 74 of each cap member bears, along its entire length, two spaced parallel longitudinal tapes or strips 76 of sealant material respectively positioned to come into continuous contact with the continuously exposed upwardly facing flat portions 34 and 46 of the two panel flange legs at a standing seam, i.e. when the cap member is snap-fittingly mounted on the seam as described above. These strips 76 may be constituted of a conventional adhesive sealant tape such as is used to seal joints between facing metal or other surfaces against penetration of moisture, e.g. a commercially available butyl tape material provided as a preformed tape, or may be constituted (for example) of a commercially available butyl-type caulking compound.

In the installation of the described roof system, multiple anchoring clips 14 are screw-fastened to the supporting roof structure (e.g. to purlins or support beams) at regularly spaced intervals in a first row extending from the eave to the roof ridge, i.e. a row parallel to the lines at which the standing seams 12 are to be located. A layer of insulation 18, which can be either rigid or soft and compressible (since the panels 10 are wholly supported by the clips 14), is placed over the supporting roof structure adjacent the first row of anchoring clips, if desired. At the first row of clips 14 the second flange 26 of a panel 10 is rotated underneath the second upper portions 54 of the clips of that row, until it reaches the position shown in FIG. 6; the configuration of the panel flange leg 40 and the clip upper portion 54 facilitate this operation. Another series of clips 14 are then fitted onto the first flange 24 of the same panel and secured to the supporting roof structure as shown in FIG. 5, to constitute a second row of spaced clips; and the layer of insulation (if used) is continued beyond the second row. Thereafter, the second flange 26 of the next adjacent panel is rotated underneath the second upper portions 54 of this second row of anchoring clips, until it also reaches the position shown in FIG. 6. Both panel flanges 24 and 26, when in place as illustrated in FIG. 6, are held by the clips 14 against vertical and lateral movement but are free to move longitudinally in the event of thermal expansion or contraction.

After the described panel-mounting operation has been repeated across the roof, with successive installation of rows of clips and panels, the cap members 16 are individually aligned with the respective standing seams and manually snap fitted (i.e. pushed down by hand) over the flange legs at the seams, to lock the cap members in place. Hand pressure or roll pressure is thereafter applied along the top surfaces of the cap members to ensure that the sealant tapes 76 adhere continuously to the upwardly facing flat portions 34 and 46 of the panel flange legs, both at the positions of the clips 14 (FIG. 6) and intermediate the clips (FIG. 7).

It is to be understood that the invention is not limited to the features and embodiments hereinabove specifically set forth, but may be carried out in other ways without departure from its spirit.

I claim:

1. A standing seam roof system comprising, in combination with supporting roof structure, (a) a plurality of elongated roofing panels each having a central web and first and second longitudinal flanges respectively projecting upwardly therefrom along opposite sides of the panel, with the upper portions of each flange bent inwardly to form a longitudinal leg extending toward the other flange of the panel in vertically spaced parallel relation to the web, said panels being disposed on the roof structure in side-by-side parallel array with the first flange of one panel closely adjacent the second flange of the next panel in the array to constitute therewith a standing seam;

(b) a plurality of anchoring clips fixedly secured to the roof structure in spaced relation to each other along each standing seam, each of said clips including a flat vertical body interposed between the first flange of one panel and the second flange of the next panel at a standing seam, first and second upper portions respectively projecting in opposite directions from the top of said flat body for respectively overlying and engaging the legs of said last-mentioned first and second flanges, and first and second lower portions respectively projecting in opposite directions from said flat body below said upper portions for respectively underlying and supporting the webs of said one panel and said next panel at said last-mentioned seam; and (c) for each standing seam, an elongated, resiliently deformable and snap-fittingly mountable cap member of downwardly opening C-shaped cross section snap fitted over the leg of the first flange of one panel and the leg of the second flange of the next panel at that standing seam to cover the gap therebetween, above the upper portions of the anchoring clips at that standing seam;

(d) the leg of each panel flange having an upwardly facing flat portion parallel to the panel web;

(e) a body of sealant material being interposed between each of the cap members and the upwardly facing flat portion of each flange leg over which the cap member is fitted, along the full length of the cap member;

(f) the leg of the first flange of each panel being formed with a longitudinal, upwardly concave groove, and the first upper portion of each clip being formed with a downwardly convex bead receivable in said groove; and (g) the leg of the second flange of each panel curving inwardly, then upwardly, and then again inwardly to the flat portion thereof, and the second upper portion of said clip curving upwardly to a free longitudinal edge for conformingly overlying the upward curve of the second flange leg of a panel.

2. A system as defined in claim 1, wherein each leg of each flange has a free longitudinal edge formed with a return curve, and wherein said cap member has two resilient inwardly curved longitudinal legs spaced apart, in unstressed condition, by a distance such that when the cap member is pressed downwardly over the legs of adjacent flanges at a standing seam, the cap member legs deform outwardly to slide downwardly over the return curves of the last-mentioned flange legs and then spring back toward each other to grippingly engage the last-mentioned flange legs.

3. A system as defined in claim 1, wherein the upwardly facing flat portion of each flange leg projects inwardly of the clip upper portion engaging that leg so as to be continuously exposed along the length of the panel, and wherein each of said cap members has a central web with a downwardly facing surface bearing two longitudinal strips of said sealant material respectively positioned to come into contact with the continuously exposed flat portions of the two flange legs over which the cap member is snap fitted.

4. A system as defined in claim 1, wherein each clip further includes a foot portion extending downwardly from said flat body and fixedly securable to said roof structure, for supporting the clip thereon with the lower portions of the clip spaced above the roof structure to provide a gap between the roof structure, and the panel webs.

5. A system as defined in claim 4 wherein said gap is filled with thermally insulating material.

6. A standing seam roof system comprising, in combination with supporting roof structure, (a) a plurality of elongated roofing panels each having a central web and first and second longitudinal flanges respectively projecting upwardly therefrom along opposite sides of the panel, with the upper portion of each flange bent inwardly to form a longitudinal leg extending toward the other flange of the panel in vertically spaced parallel relation to the web, said panels being disposed on the roof structure in side-by-side parallel array with the first flange of one panel closely adjacent the second flange of the next panel in the array to constitute therewith a standing seam;

(b) a plurality of anchoring clips fixedly secured to the roof structure in spaced relation to each other along each standing seam, each of said clips including a flat vertical body interposed between the first flange of one panel and the second flange of the next panel at a standing seam, and first and second upper portions respectively projecting in opposite directions from the top of said flat body for respectively overlying and engaging the legs of said last-mentioned first and second flanges, and (c) for each standing seam, an elongated, resiliently deformable and snap-fittingly mountable cap member of downwardly opening C-shaped cross section snap fitted over the leg of the first flange of one panel and the leg of the second flange of the next panel at that standing seam to cover the gap therebetween, above the upper portions of the anchoring clips at that standing seam;

(d) the leg of each panel flange having an upwardly facing flat portion parallel to the panel web;

(e) a body of sealant material being interposed between each of the cap members and the upwardly facing flat portion of each flange leg over which the cap member is fitted, along the full length of the cap member;

(f) the leg of the first flange of each panel being formed with a longitudinal, upwardly concave groove and the first upper portion of each clip being formed with a downwardly convex bead receivable in said groove; and (g) the leg of the second flange of each panel curving inwardly, then upwardly, and then again inwardly to the flat portion thereof, and the second upper portion of said clip curving upwardly to a free longitudinal edge for conformingly overlying the upward curve of the second flange leg of a panel.

* * * * *